US006460953B2

(12) United States Patent
Hällsten

(10) Patent No.: US 6,460,953 B2
(45) Date of Patent: Oct. 8, 2002

(54) CASSETTE INTENDED FOR THE CONSTRUCTION OF DRAWER CABINETS

(75) Inventor: Lars Hällsten, Täby (SE)

(73) Assignee: System Edstrom Bilinredningar AB, Uppsala (SE)

( * ) Notice: Subject to any disclaimer, the term of this patent is extended or adjusted under 35 U.S.C. 154(b) by 0 days.

(21) Appl. No.: 09/793,776

(22) Filed: Feb. 27, 2001

(65) Prior Publication Data

US 2001/0017510 A1 Aug. 30, 2001

(30) Foreign Application Priority Data

Feb. 29, 2000 (SE) ..... 0000650-2

(51) Int. Cl.[7] ..... A47B 88/00
(52) U.S. Cl. ..... 312/334.1; 312/350
(58) Field of Search ..... 312/107, 108, 312/111, 334.36, 330.1, 334.1, 334.6, 334.27, 350; 384/20, 23; 108/901

(56) References Cited

U.S. PATENT DOCUMENTS

| | | | | |
|---|---|---|---|---|
| 405,166 A | * | 6/1889 | Katherman et al. | 312/350 |
| 2,657,968 A | * | 11/1953 | Soehner | 312/350 X |
| 3,779,623 A | | 12/1973 | Motohashi | |
| 4,236,773 A | * | 12/1980 | Mertes | 312/350 X |
| 4,761,081 A | * | 8/1988 | Mulford | 384/20 |
| 4,848,608 A | | 7/1989 | Anderson | |
| 5,681,102 A | * | 10/1997 | Forsgren | 312/334.1 |

FOREIGN PATENT DOCUMENTS

| | | |
|---|---|---|
| DE | 92 15 904 | 4/1993 |
| EP | 0 300 134 A1 | 1/1989 |
| WO | 96/12424 | 5/1996 |

* cited by examiner

*Primary Examiner*—Janet M. Wilkens
(74) *Attorney, Agent, or Firm*—Young & Thompson

(57) ABSTRACT

A cassette for building up drawer cabinets and a drawer included in the cassette. In order to carry and guide the drawer inside the cassette, a rail made of plastic is arranged on each side of the cassette, the rail being mountable on a lower flange projecting inwards from each side wall of the cassette. From the top side of the rail, a longitudinal ridge protrudes, which is distanced from an outside pressable against the side wall of the cassette with a distance which in the main corresponds to half the difference between the width of the cassette and the width of the drawer, and the rail at opposite end portions having similar ramp surfaces, which are oblique in the direction upwards/inwards from the ends of the rail towards the plane top side of the rail. In this way, one and the same rail is, in a universal way, mountable either to the right or to the left in the cassette.

4 Claims, 3 Drawing Sheets

CASSETTE INTENDED FOR THE CONSTRUCTION OF DRAWER CABINETS

TECHNICAL FIELD OF THE INVENTION

Figure 1:
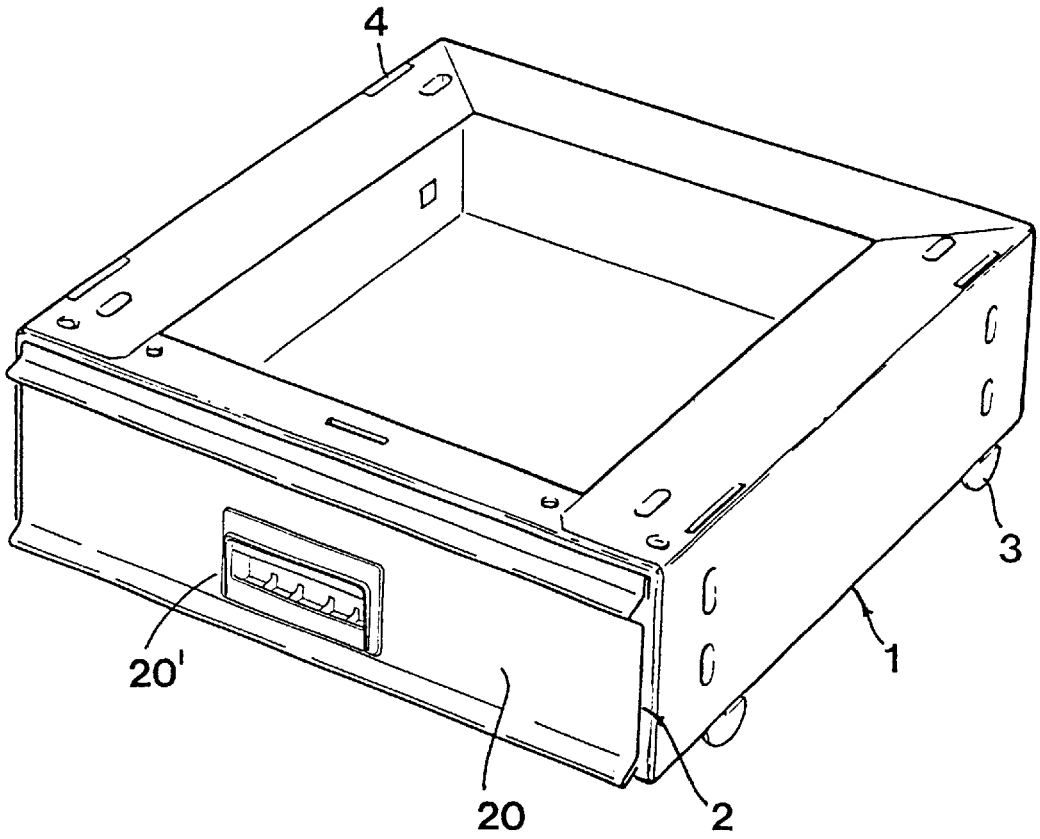

This invention relates to a cassette intended for building up drawer cabinets of the type that includes a rectangular frontal frame from which two side walls extend, which are interconnected via a rear wall and each one of which includes upper and lower flanges which extend inwards from the appurtenant side walls, the individual lower flange at a free inner edge having an upwardly bent border and the cassette accommodating a drawer, which comprises a frontal piece, a bottom, two side pieces and a rear piece.

PRIOR ART

Cassettes for drawer cabinets of the kind generally mentioned above are previously known by, for instance, DE 3905843, EP 739177 and EP 739178 . In the basic embodiments thereof, these known cassettes for drawer cabinets are, on the bottom side thereof, formed with four hook-shaped metal sheet portions, which may be inserted and locked in a corresponding number of slit-shaped holes in the top side of a subjacent cassette. The cassettes are commercially available in different embodiments, in particular in embodiments with different heights and width, respectively, whereby the user is offered a large freedom to construct, in a simple way, drawer cabinets adapted to individual needs. Also the possibility of choosing how the drawer should be guided inside the appurtenant cassette is, to a large extent, part of this freedom. In a standard embodiment, the cassettes are equipped with elementary, inexpensive guiding members in the form of two cross-section-wise L-shaped rails of thin sheet, which are welded adjacent to the lower flanges of the side walls of the cassette in the way which is shown, for instance, in EP 739178 (see FIG. 4). However, if the buyer so desires, this standard embodiment may be supplemented with more sophisticated, and relatively expensive guiding members in the form of separate rails which may be mounted on the inside of the side walls of the cassette and the outside of the side pieces of the drawer, respectively, and which are provided with rolls, which facilitate the pushing and pulling, respectively, of the drawer into and out from the cassette. One type of such roll-equipped guide rails is disclosed in EP 739177, although also other, yet more expensive guiding members in the form of roll-equipped rails are found on the market.

In the simple standard embodiment of the previously known cassettes for drawer cabinets, the cross-section-wise L-shaped thin sheet serving as guide rail gives only a mediocre guide ability at the same time as the pushing in and pulling out, respectively, of the drawer frequently becomes cumbersome. Because the drawer as well as the L-rails are made of varnished thin sheet, the friction between the surfaces on the drawer and rails, respectively, being in contact with each other becomes rather large. Furthermore, this contact entails that the layers of varnish wear out during exposure of the proper sheet-metal;

something which in turn may lead to corrosion. Another disadvantage of the known cassettes for drawer cabinets is that the L-rails require a particular, cost-demanding welding operation in connection with the manufacture.

OBJECTS AND FEATURES OF THE INVENTION

The present invention aims at obviating the above-mentioned inconveniences of standard embodiments of previously known cassettes for drawer cabinets and at providing an improved cassette for a drawer cabinet. Therefore, a primary object of the invention is to provide a cassette for a drawer cabinet, the means of which for carrying and guiding the drawer is structurally simple and inexpensive at the same time as the same permits a good guiding of the drawer in connection with the pushing-in and pulling-out, as well as offering a low frictional resistance against said motions so as to facilitate the handling of the drawer by the user. An additional object is to provide a cassette for a drawer cabinet, the drawer of which does not risk to have the varnished coating thereof worn out by the contact with the guiding means of the cassette.

BRIEF DESCRIPTION OF THE APPENDED DRAWINGS

Figure 2:
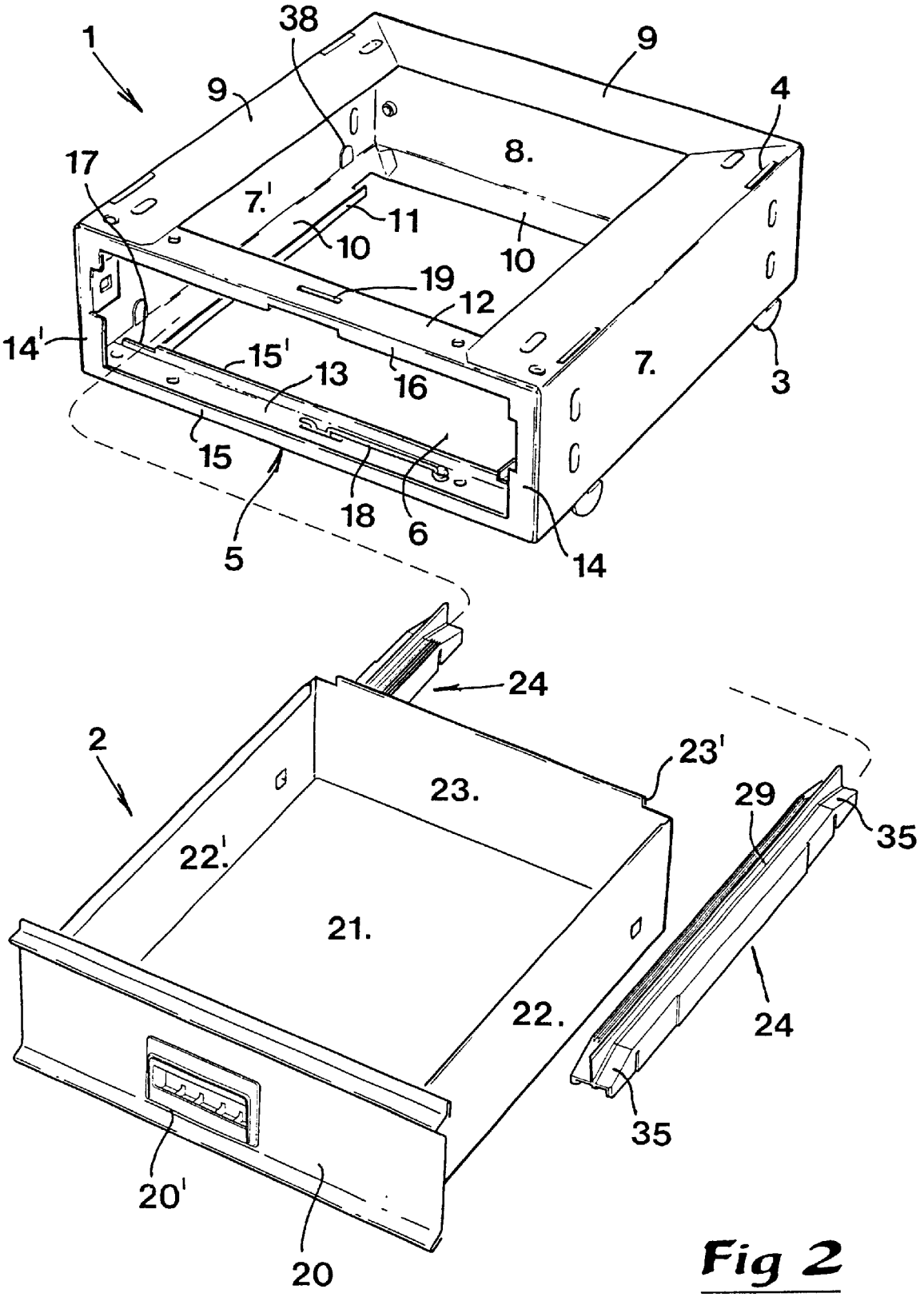
Figure 3:
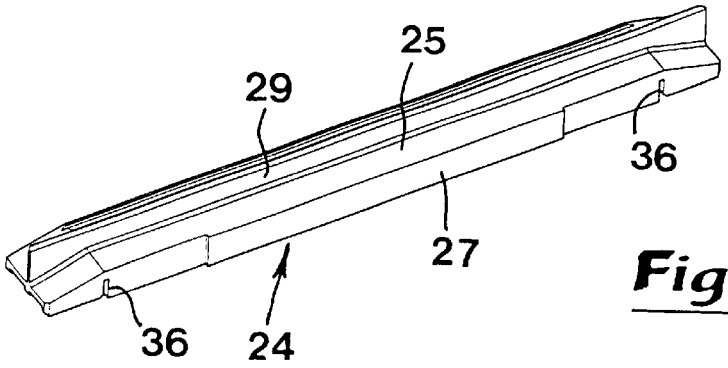
Figure 4:
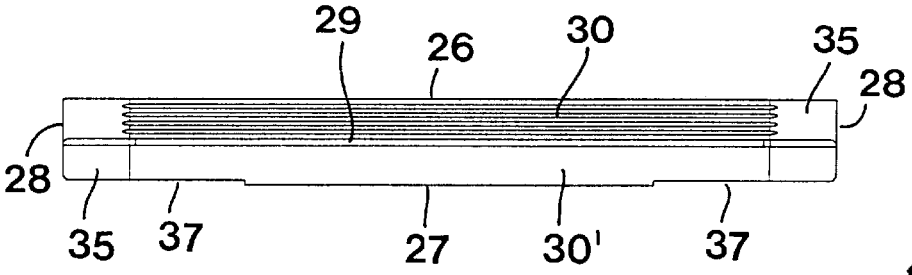
Figure 5:
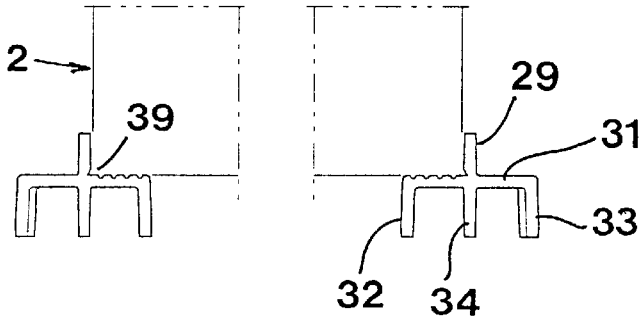
Figure 6:
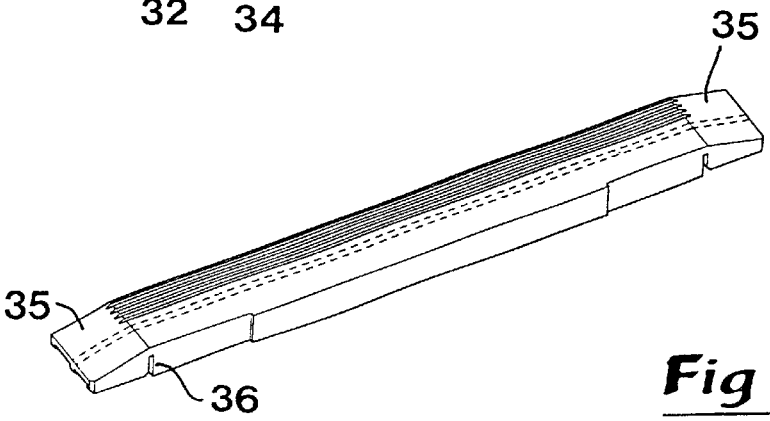

In the drawings:

FIG. 1 is a perspective view showing a cassette for a drawer cabinet made according to the invention, the drawer of which is pushed into the cassette, FIG. 2 is an exploded view of the same cassette with the drawer shown spaced-apart from the proper cassette together with two guide rails according to the invention, FIG. 3 is a perspective view of an individual guide rail according to the invention, FIG. 4 is a planar view from above of the guide rail according to FIG. 3, FIG. 5 is a schematic end view showing the co-operation of the guide rails with a drawer which is outlined with dash-dotted lines, and FIG. 6 is a perspective view of a modified guide rail.

DETAILED DESCRIPTION OF A PREFERRED EMBODIMENT OF THE INVENTION

In FIG. 1, a cassette for a drawer cabinet is shown which includes two main components, viz. a proper cassette 1 and a drawer 2, which in FIG. 1 is pushed into the cassette. On the bottom side of the cassette 1, there are four hook members 3, which are insertable in a corresponding number of slit shaped holes 4 in the top side of the cassette to interconnect a suitable number of cassettes stacked on each other with the purpose of forming a drawer cabinet having the desired height.

In FIG. 2 is seen how the cassette 1 includes a frontal frame in its entirety designated 5, which defines an opening 6 for receiving the drawer. Rearwards from the frontal frame 5, two side walls 7, 7' extend, the two rear ends of which are interconnected via a rear wall 8. Each one of said walls 7, 7' and 8 includes an upper flange 9 as well as a lower flange 10. In practice, the walls may be made of one single continuous, thin-walled piece of sheet-metal, which is punched out of a blank and is bent into U-shape as seen cross-section-wise as well as in contour. The two lower flanges 10 (one of which is visible in FIG. 2) which project inwards from the lower edge of each side wall 7, 7' have at the inner, free edges thereof a bent border 11, which extends upwards from the flange at approximately a right angle thereto.

The front ends of the U-profiles that are formed by the side walls 7, 7' surround the opposite ends of the frontal frame 5 and are connected thereto in a suitable way, e.g. by spot-welding or pressing. Also the proper frontal frame 5 is advantageously made of a thin sheet, which by punching and bending has been given a U-shaped cross-section. In FIG. 2, reference numeral 12 designates a top piece, 13 a bottom piece and 14, 14' two vertical side pieces included in said frontal frame. The bottom piece 13 has two spaced-apart, comparatively low borders 15, 15', which are bent perpendicularly to a central web in the bottom piece. Correspondingly, the top piece 12 has two comparatively thin borders 16, of which only one is visible in FIG. 2. It should be especially noted that the two opposite end portions of the inner border 15' of the bottom piece extending outside the border 11 of the side flange 10 are cut out at 17 in order to obtain a lower height than the rest of the border 15'.

For the sake of completeness, it should also be pointed out that the cassettes stacked on each other in a drawer cabinet may be locked in relation to each other by means of a locking finger 18 of a resilient character mounted on the bottom piece 13 of the frontal frame 5, which finger may be engaged in a slit 19 in the frame top piece.12 on each subjacent cassette.

The drawer 2 includes a frontal piece 20, a bottom 21, two side pieces 22, 22' as well as a rear piece 23. Said components, which advantageously consist of a bent thin sheet, together form a substantially parallelepipedical drawer. The frontal piece 20 is larger than the rear piece 23, which in turn is only slightly smaller than the opening 6 in the frontal frame S of the cassette. It should be especially observed that the rear piece 23 has a height which is somewhat larger than the height of the side pieces 22, 22' , whereby an upper portion 23' of the rear piece 23 will protrude somewhat above the upper edges of the side pieces. This protruding edge portion 23' has the purpose of locking the drawer the cassette when the drawer is pulled out to the outer end position thereof in relation to the cassette. When the insert drawer is to be mounted in the cassette, the drawer is inserted in a position leaning obliquely upwards/forwards in which the protruding edge portion 23' may be inserted behind the top piece 12 of the frontal frame, whereafter the drawer is turned down to a horizontal state in which it may be pushed into the cassette. In this state, the edge portion 23' serves as a stopping element for the drawer.

In the frontal piece 20, a lock 20' is mounted in order to lock the drawer in the fully pushed-in state thereof As far as the cassette for a drawer cabinet shown in FIGS. 1 and 2 has been described hitherto, the same is in all essentials previously known by the publications mentioned above.

According to the invention, two rails 24 are arranged for guiding the drawer 2, which rails have, in a way characteristic of the invention, a universal character inasmuch as one and the same type of rail may be mounted on the left side as well as the right side of the cassette. The nature of the guide rail 24 is seen closer in FIGS. 3–6.

In FIGS. 3 and 4, reference numeral 25 generally designates a top side of the rail, while 26 and 27 designate opposite side surfaces. The opposite ends of the rail are designated 28. The rail is intended to be mounted resting on the individual lower flange 10 of the side walls of the cassette 1. For this purpose, the rail has a width which in the main corresponds to the distance between the individual side wall 7, 7' and the border 11 of the flange 10 and a length which is only slightly smaller than the length or depth of the cassette. In addition, the height of the rail is at least somewhat larger than the height of the border 11 so that the top side 25 is located on a certain, although limited level above the upper edge of the border 11. From the top side of the rail, a longitudinal ridge 29 protrudes, which advantageously extends along the entire length of the rail. The distance between said ridge 29 and the side surface 27 which is intended to be pressed against the inside of the side wall of the cassette 7, 7' equals in the main half the difference between, on one hand, the width of the cassette (counted between the insides of the side walls 7, 7') and, on the other hand, the width of the drawer 2 (counted between the outsides of the side pieces 22, 22'). In this way, the side pieces 22, 22' of the drawer will abut with a comparatively fine fit against one side of the ridge while guaranteeing a good guiding of the drawer in relation to the ridges.

The part of the top side 25 of the rail which is situated between the ridge 29 and the side surface 26 has a grooving 30 which has been provided by the fact that long narrow material portions are spaced apart by thin grooves. Said grooving reduces the contact surface between the top side of the rail and the portions of the bottom 21 of the drawer abutting against the rail without reducing the carrying ability of the rail.

According to an important feature of the invention, the rail 24 is made from plastic, particularly any form of plastic having a smooth surface structure. In practice, polyamide (in particular polyamide without glass phases) is preferred as material in the rail.

In FIG. 5 is seen how the individual rail has a fork-like cross-section shape by including a plurality of flanges 32, 33, 34 protruding downwards from the web in addition to a horizontal web 31 and the upwardly directed ridge 29. More precisely, the rail includes two outer side flanges 32, 33 and a central flange 34 situated vertically below the ridge 29. Generally, the side flanges 32, 33 are made with a width which in an unmounted state of the rail is at least partially somewhat larger than the width between the individual side wall of the cassette 7, 7' and the insides of the border 11 so as to provide, when mounting the rail on the appurtenant cassette flange 10, a certain press fit between, on one hand, the flanges of the rail and on the other hand the side wall of the cassette and the border, respectively. In practice, this press fit may be provided by the fact that the side flanges 32, 33 diverge slightly in the direction downwards (e.g. at an angle of 3°) at the same time as the space between a side wall 7, 7' and the appurtenant border 11 diverges upwards at a smaller angle (e.g. 2°).

At the opposite ends thereof, the rail 24 has oblique ramp surfaces 35, which are identical inasmuch as they are equally long and lean in a direction obliquely upwards/inwards from the respective ends 28, 28' of the rail. Each such ramp surface has the purpose of facilitating the insertion of the drawer in the cassette in connection with the mounting, as well as providing for that the drawer may lean obliquely outwards/downwards in the maximum pulled-out position thereof and in conjunction herewith provide a certain support against the bottom side of the drawer.

Approximately in the area of the transition between the top side 25 and the individual ramp surface 35, downwardly opening grooves 36 are recessed in the three flanges 32, 33, 34, in which grooves the cassette border 15' may engage. These grooves 36 are identically shaped at each one of the two opposite end portions of the rail.

It should also be mentioned that the side surface 27 which connects to the non-grooved, plane part 30' of the top side 25 is interrupted at a certain distance from the two ends of the rail by means of narrowed surfaces 37. When the rail is mounted in the cassette, a narrow space is formed between the surfaces 37 and the inside of the appurtenant side wall 7, 7' of the cassette in which sheet metal details 38 (see FIG. 2) may be housed.

A substantial advantage of the described guide rail is that one and the same rail may in a universal way be used on the left side as well as the right side of the cassette. In other words, one and the same rail may be series-produced in one and the same embodiment at low costs. By the fact that the rail is made of plastic, in particular plastic having a smooth surface, the two assembled rails in each cassette will guide the drawer in a distinct way in connection with the pushing-in and pulling-out, as well as guarantee that the displacement of the drawer between outer and inner end positions may take place at a minimum of frictional resistance in the interface between the bottom side of the drawer bottom and the top side of the rail. The low friction is especially accentuated by the fact that the carrying part of the top side of the rail is grooved as is shown in the example in the drawings.

According to a preferred embodiment of the invention, the ridge 29 is possible to break away. For this purpose, at least one indication of fracture 39 may be formed at the lower part of the ridge connecting to the rail, which indication of fracture has the purpose of facilitating removal of the ridge, e.g. by means of a knife or the like. In FIG. 6, a rail is shown from which the ridge 29 has been removed. In this state, the rail may be used as a supplementary carrying member for the drawer, the rail being placed approximately halfway between the two side walls of the cassette. Here the border 15' engages the grooves 36 at the front end of the rail and keeps the rail in a state approximately parallel to the side walls of the cassette.

What is claimed is:

1. Cassette intended for building up drawer cabinets (1) of the type that includes a rectangular frontal frame (5) from which two side walls (7, 7') extend, which are interconnected via a rear wall (8) and each one of which includes upper and lower flanges (9, 10), which extend inwards from the appurtenant side wall, the individual lower flange (10) at a free, inner edge having an upwardly bent border (11), and the cassette accommodating a drawer (2), which comprises a frontal piece (20), a bottom (21), two side pieces (22, 22') and a rear piece (23), characterized in that a rail (24) made of plastic is arranged for carrying and guiding the drawer (2) inside the cassette (1), the width of which rail mainly corresponds to the distance between the individual side wall (7, 7') and the border (11) of the appurtenant lower flange (10) and the length of which is only slightly smaller than the length of the cassette, at the same time as the thickness of the rail is at least somewhat larger than the height of the border (11), that a longitudinal ridge (29) protrudes from a top side (25) of the rail, which ridge is distanced from an outer side of the rail (27) pressable against the side wall (7, 7') of the cassette with a distance which corresponds to half the difference between the width of the cassette and the width of the drawer enabling the ridge to guide the drawer when the rail is applied to said lower flange (10), and that the rail at opposite end portions has similar ramp surfaces (35), which are oblique in the direction upwards/inwards from the ends (28, 28') of the rail towards the plane top side (25), whereby one and the same rail is mountable either to the right or to left in the cassette while maintaining one and the same function.

2. Cassette according to claim 1, characterized in that a part of the top side (25) of the rail in the mounted state thereof, positioned inside of the guiding ridge (29), has a grooving (30) with the purpose of, for a given width, reducing the contact surface and thereby the friction between the rail and the bottom (21) of the drawer (2).

3. Cassette according to claim 1, characterized in that the rail (24) has a fork-like cross-sectional shape by including, in addition to a horizontal web (31) with the ridge (29) protruding therefrom, at least two side flanges (32, 33) projecting downwards from the web, the width between said flanges in the unmounted state of the rail being at least partially somewhat larger than the width between the side wall (7, 7') of the cassette and the inside of the border so as to provide, when mounting the rail on the appurtenant cassette flange (10), a certain press fit between, on one hand, the flanges (32, 33) of the rail and, on the other hand, the side wall of the cassette and the border, respectively.

4. Cassette according to claim 1, characterized in that an indication of fracture (39) is formed in the interface between the ridge (29) and the top side (25) of the rail for facilitating, at need, removal of the ridge from the rail.

* * * * *